United States Patent [19]

Ogawa

[11] 4,214,402

[45] Jul. 29, 1980

[54] TOY ASSEMBLY WITH RECONFIGURABLE PARTS AND REMOVABLE APPENDAGES

[75] Inventor: Iwakichi Ogawa, Kashiwa, Japan

[73] Assignee: Takara Co., Ltd., Tokyo, Japan

[21] Appl. No.: 950,147

[22] Filed: Oct. 10, 1978

[51] Int. Cl.[3] ..... A63H 33/06; A63H 17/00; A63H 11/10; A63H 33/26

[52] U.S. Cl. ..... 46/17; 46/249; 46/251; 46/76 R; 46/96; 46/201; 46/236; 46/202; 46/1 E; 46/145

[58] Field of Search ..... 46/17, 201, 251, 249, 46/250, 91, 103, 16, 23, 202–209, 236–240, 228, 230, 262–268, 248, 96, 76 R

[56] References Cited

U.S. PATENT DOCUMENTS

| | | | |
|---|---|---|---|
| 4,057,929 | 11/1977 | Ogawa | 46/201 |
| 4,132,028 | 1/1979 | Ogawa | 46/17 |

*Primary Examiner*—Russell R. Kinsey
*Assistant Examiner*—Michael J. Foycik, Jr.
*Attorney, Agent, or Firm*—Jackson, Jones & Price

[57] ABSTRACT

A toy assembly capable of locomotion on a solid surface and having reconfigurable component parts is disclosed. A fuselage of an airplane or rocket includes a front section configured to simulate a mobile cockpit which can be launched from the remainder of the fuselage by a spring loaded latching mechanism. Two interchangeable tail sections are provided for coupling to the fuselage. A first tail section includes a power source and a control switch to actuate an electric motor located in a center section of the fuselage. An electrical cable connects a second tail section to the first tail section whereby the toy is remotely controllable from the control switch. A multi-piece wing section is attached to either side of the fuselage. Each wing section includes a side member which, when detached from the wing provides an operable toy dart gun. The component parts of the wing sections are reconfigurable to provide other toy assemblies.

27 Claims, 7 Drawing Figures

FIG. 1
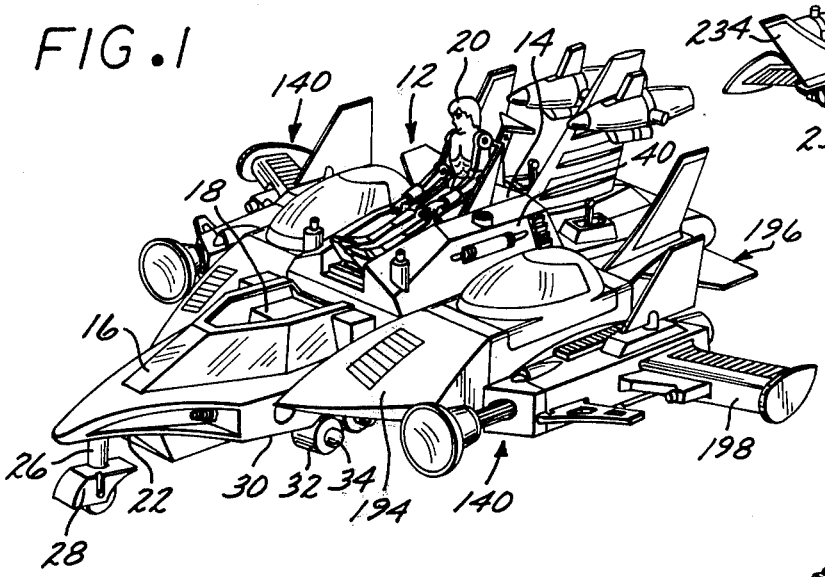
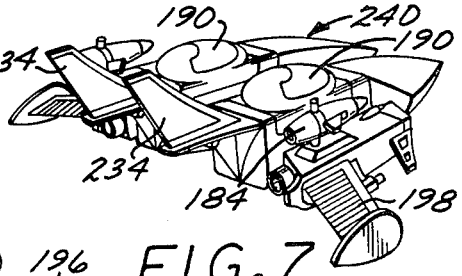
FIG. 7
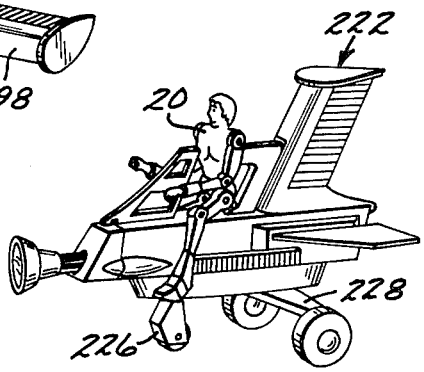
FIG. 3
FIG. 2
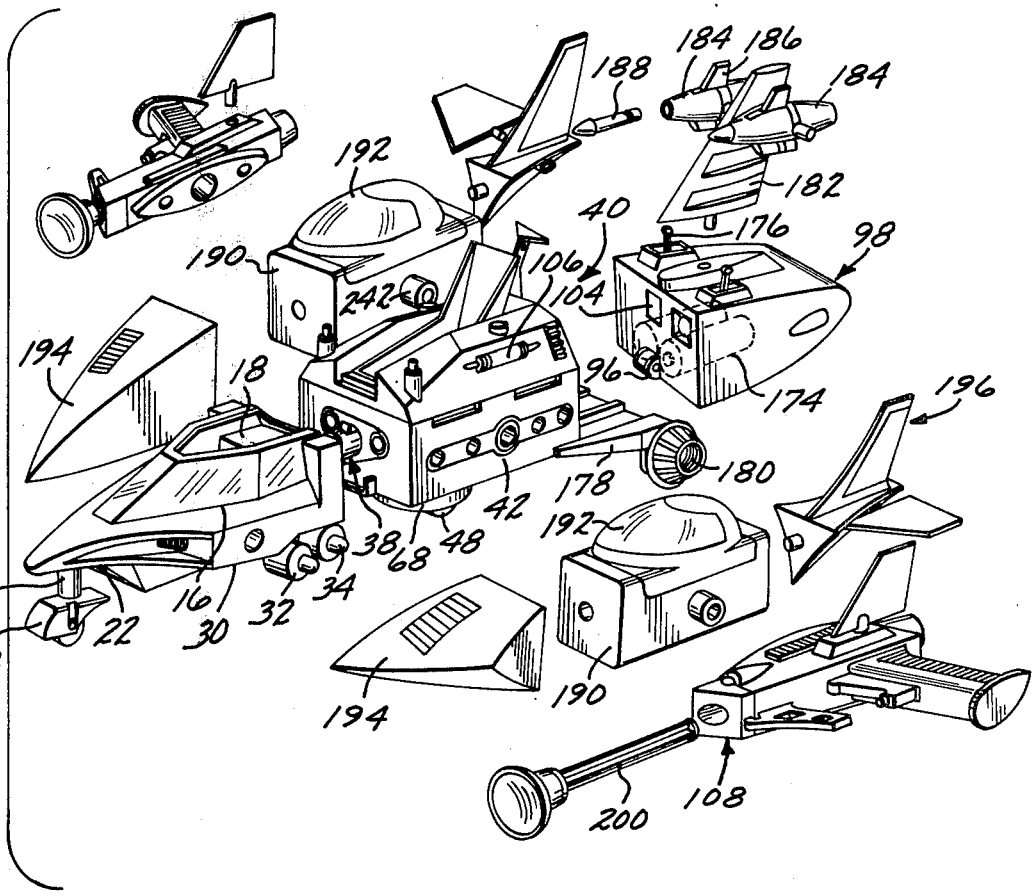

TOY ASSEMBLY WITH RECONFIGURABLE PARTS AND REMOVABLE APPENDAGES

BACKGROUND OF THE INVENTION

1. Field of the Invention

The present invention relates to a toy assembly and more particularly to a toy airplane or rocket built of a plurality of pieces that can be reconfigured to become other toys.

2. Brief Description of the Prior Art

Self propelled toy airplanes capable of locomotion on the ground are well known in the prior art. Some toy airplanes of the prior art are built from a plurality of component pieces assemblable by the children playing with the toy. These component pieces are configured to simulate the component parts of a real airplane, i.e. the wings, fuselage, tail section, etc.

Due to the inherent nature of the toy market, the toy industry is constantly striving to provide toys of unique and useful features which challenge the creative imagination and manual dexterity of the children. The toy assembly of the present invention having component parts which may be reconfigured to provide a plurality of smaller toys, is the result of an effort to provide a toy having such unique and useful features.

SUMMARY OF THE INVENTION

It is an object of the present invention to provide a versatile toy assembly which is readily assembled from a plurality of component parts by a child user of the invention.

It is another object of the present invention to provide a remotely controllable toy which is capable of locomotion on the ground.

It is still another object of the present invention to provide a toy airplane which has a realistic warplane like appearance.

It is yet another object of the present invention to provide a toy airplane, the front cockpit section of which is capable of being launched as a separate vehicle.

It is still a further object of the present invention to provide a toy airplane wherein the wings comprise a plurality of pieces reconfigurable to provide smaller toy airplanes.

It is yet a further object of the present invention to provide a toy airplane having wings assembled from a plurality of component parts wherein a component part of the wing is a functioning toy dart handgun.

It is still another object of the present invention to provide a toy airplane wherein a removable component part of the wing is a functioning toy handgun reconfigurable to become a travelling gun assembly.

These and other objects and advantages are obtained by a toy airplane having a fuselage comprising at least three parts. A front part of the fuselage simulates a cockpit and is also configured to simulate a vehicle having wheels mounted thereto. The front cockpit section is mounted to the center section by a spring loaded mechanism which is capable of ejecting or launching the front section as a vehicle. The center section houses an electric motor connected to a wheel assembly mounted on the bottom of the center section. A rear section of the fuselage with operator controls is attached by magnetic couplers to the center section. The rear section houses at least one battery to power the motor and a control switch to actuate the motor.

A second rear section is provided which is capable of supplementing the first rear section for remote control. The second rear section includes an electrical cable which can be connected to the removed first rear section. The operator can then remotely transmit power from the first rear section through the attached second rear section to the motor.

Each wing is removably attachable to the center section of the fuselage and comprises a hollow main section configured to simulate the cockpit of a smaller airplane. A pointed nose cone and a simulated control surface is removably attachable respectively to the front and rear of the hollow main section. An operable toy dart gun can be removably attached to the side of the hollow main section whereby the assembled wing provides the appearance of an airplane wing.

The component parts of the wing are further reconfigurable to provide smaller airplanes. A plurality of removably attachable wheel assemblies are provided to be assembled to the reconfigured smaller airplanes and to convert the toy dart gun, when removed from the wing, into a travelling toy gun assembly.

The objects and features of the present invention are set forth with particularity in the appended claims. The present invention may be best understood by reference to the following description, taken in connection with the accompanying drawings in which like numerals indicate like parts.

BRIEF DESCRIPTION OF THE DRAWINGS

FIG. 1 is a perspective view of an assembled toy airplane of the present invention;

FIG. 2 is an exploded perspective view of the toy airplane of the present invention;

FIG. 3 is a perspective view of a toy dart gun of the present invention which has been reconfigured into a travelling toy gun assembly;

FIG. 7 is a perspective view of a second smaller airplane which is obtained by reconfiguring a plurality of component parts of the wing sections of the toy airplane of the present invention.

DESCRIPTION OF THE PREFERRED EMBODIMENT

Figure 4:
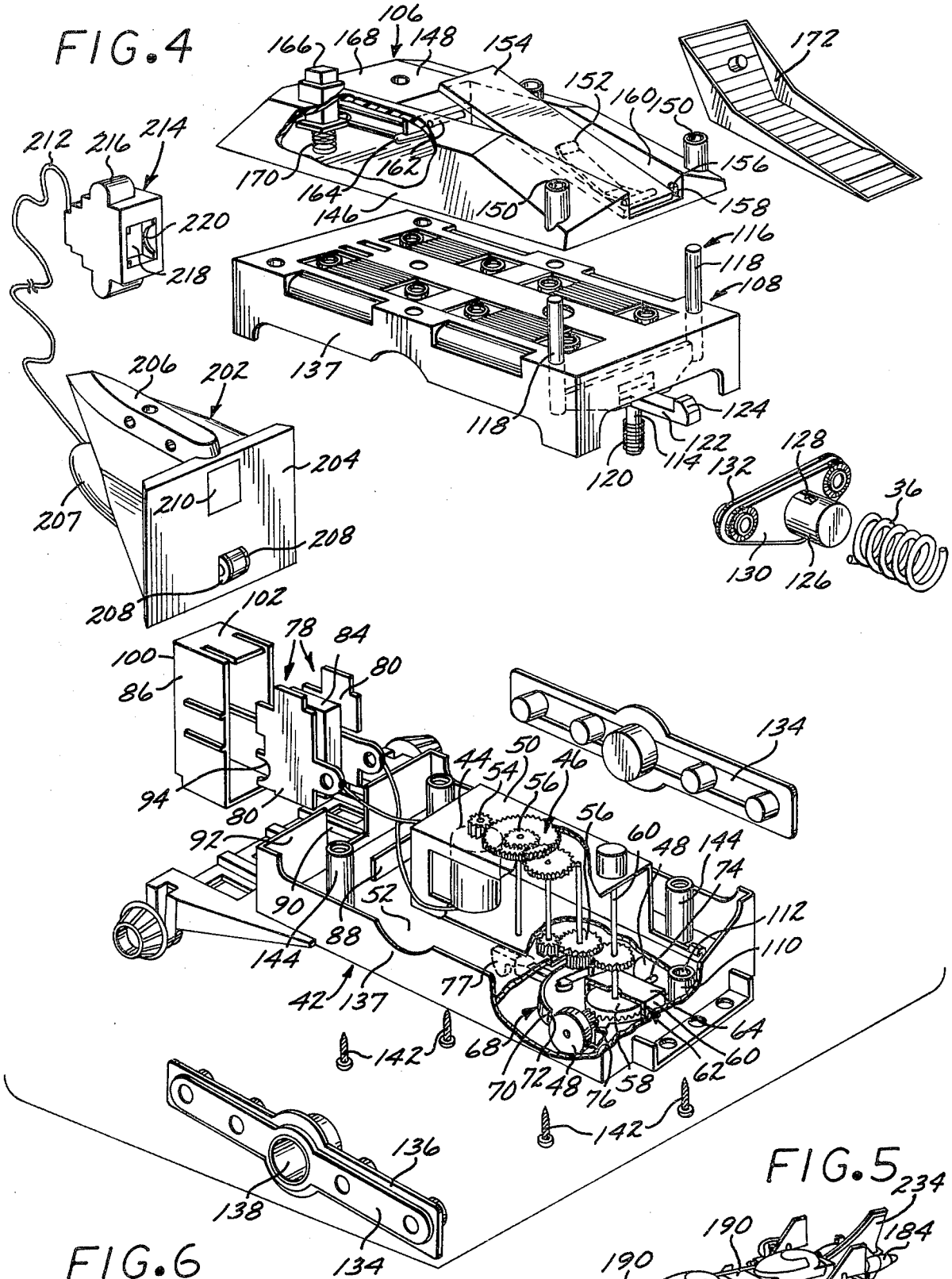
FIG. 4 is a partially exploded perspective view of a center section and a second tail section of the toy airplane of the present invention with a portion of the center section broken away.

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventor for carrying out his invention in a commercial environment, although it should be understood that various modifications can be accomplished within the parameters of the present invention.

Referring specifically to FIGS. 1 and 2, the toy airplane 12 of the present invention is disclosed. A fuselage body 14 having an elongated shape comprises three sections. A front section 16 is shaped to simulate a cockpit of an airplane. The front section is hollow and has an opening 18 on the top thereof. Through the opening 18, a suitably sized toy doll or robot 20 may be placed into the front section 16 thus enhancing the realistic appearance of an airplane with a pilot in the cockpit.

The front section 16 is pointed, and in its overall appearance, when detached from the toy airplane of the present invention simulates a secondary vehicle.

An underside 22 of the pointed nose 24 has a cylindrical protrusion 26 having a round bore or aperture (not shown) therein. A front wheel assembly 28 having a cylindrical stud (not shown) is removably mounted to the front section by press fitting the stud into the bore or aperture. Generally, except where otherwise indicated, the component parts of the toy airplane of the present invention are removably attached to one another by press fitting cylindrical studs into matching bores or apertures.

On the lower rear portion 30 of the front section 16, a pair of wheels 32 is mounted on each side. The mounting of the wheels 32 is accomplished by sliding the wheels 32 having an aperture (not shown) in the centers thereof unto laterally extending axles (not shown). The axles are integrally built with the front section 16. A small substantially cylindrical cap 34 having an aperture (not shown) in the center thereof is press fitted into each axle and thereby secures each wheel 32 on the axle.

Since the front section 16 is equipped with wheels and simultaneously simulates the shape of both a vehicle and that of an airplane cockpit as well, the front section 16 when separated from the toy airplane comprises a separate toy vehicle.

An aperture (not shown) having its longitudinal axis parallel with the general longitudinal axis of the front section 16 is located in the rear of the front section. A spring 36, shown in FIG. 4, is secured within the aperture. The entire front section 16 is connected through a latching mechanism 38 to a center or main body section 40 of the fuselage 14. The structure of the latching mechanism 38 and its ability to eject the front section 16 from the toy airplane is described in detail below.

Referring to the exploded view of FIG. 4, the center or main section 40 is disclosed in detail. The center section 40 comprises a rectangularly shaped lower member 42 which houses an electric motor 44 and a suitable gear mechanism 46 to drive a pair of drive wheels 48. The electric motor 44 and the gear mechanism are incorporated in a metal frame 50 which is attached by a screw (not shown) to a substantially rectangular base plate 52 of the lower member 42.

The electric motor 44, the gear mechanism 46 and the drive wheels 48 are designed to lend the toy airplane of the present invention an ability to move in a plurality of directions including movements having a directional component angular to the general longitudinal axis of the toy airplane 12. The structure of the gear mechanism 46 and the drive wheels 48 is described below.

Rotational movement developed by the electric motor 44 is transmitted from a pinion gear 54 located on top of the metal frame 50 through a reduction gear assembly 56 to a crown gear 58. The axle 60 of rotation of the crown gear 58 is disposed vertically. The crown gear 58 itself is located below the base plate 52. A metal plate 62 having a horizontally disposed base 64 and two orthogonal side plates 66 is rotatably suspended on the vertically disposed axle 60. A round disc 68 preferrably made from suitable plastic material and having a perpendicular peripheral edge 70 is suspended from the orthogonal side plates 66. A plurality of bendable metal prongs (not shown) incorporated in the orthogonal side plates 66 secure the disc 68. The disc 68 has a plurality of slots (not shown) to receive the prongs (not shown). It also has a pair of parallelly disposed larger slots 72 to accomodate the drive wheels 48. The two drive wheels 48 are rigidly interconnected by a horizontally disposed axle 74. The axle 74 of the drive wheels 48 incorporates a gear 76 which engages the crown gear 58.

Since the drive wheels 48 together with the metal plate 62 and the round disc 68 are rotatably attached to the vertical axle 60 of the crown gear 58, rotational movement transmitted from the electric motor 44 is capable of rotating the drive wheels 48 relative to their horizontally disposed axle 74. It is also capable of rotating the entire drive wheel assembly relative to the vertically disposed axle 60. As a result, the movement of the toy airplane 12 of the present invention is in the path of the last resistance. Therefore as the toy airplane 12 encounters an obstacle in the path of its movement it simply changes direction of movement. The above described ability to change direction is an additional feature of the toy airplane 12 of the present invention.

In order to further enhance the versatility of the toy airplane 12 the rotation of the electric motor 44 is reversable by a suitable switch which is described below. In order to add still an additional play option to the toy airplane 12, a suitable latching mechanism 77 is provided on a lower side of the base plate 52. The latching mechanism 77 is capable of reversably locking the disc 68 in a position wherein the drive wheels 48 are disposed for propelling the airplane 12 only in the direction of its general longitudinal axis. Thus, when the latching mechanism is engaged, the toy airplane 12 is capable only of forward or rearward movement and loses the ability to change direction when an obstacle is encountered in its path.

Electric power is supplied to the motor 44 through a pair of arcuate magnetizable contact elements 78. Each contact element 78 comprises a substantially vertically disposed magnetizable metal plate 80 having a lead wire 82 attached thereto. The lead wires are connected to brushes (not shown) within the motor 44.

The metal plate 80 of each contact element 78 is positioned laterally to and in contact with a rectangularly shaped permanent magnet 84. The permanent magnet 84 is electrically nonconductive, at least on the surfaces thereof which are in contact with the contact elements 78. This is necessary in order to avoid shorting the circuit with current that would otherwise flow through the magnet 84.

The permanent magnet 84 and the metal plates 80 of the contact elements 78 are disposed in a substantially rectangularly shaped housing 86 which is preferrably constructed of suitable plastic material. The housing 86 is kept in operative position within the lower member 42 of the center body section 40 by a vertically disposed plate 88 which protrudes from the base plate 52. The housing 86 is accomodated and further held in place by a suitably sized slot 90 provided in a front wall 92 of the lower member 42.

As the housing 86 is held in operative position within the lower member 42 the arcuate edges 94 of the contact elements 78 are available for coupling via magnetic forces and for electric contact with matching, magnatizable terminals 96, shown in FIG. 2, in a rear or tail section 98 of the fuselage 14.

The metal plate 80 of each contact element 78 additionally protrudes from the housing 86 on a rear vertical 100 and on a top horizontal side 102 thereof. There it comes into magnetic contact respectively with an appropriately disposed magnetizable metal plate 104, shown in FIG. 2, on the rear or tail section 98 and on an upper member 106 of the center section. The magnetic attraction developed between the metal plate 104 on the rear or tail section 98 and the metal plates 80 serves to strengthen the physical attachment of the rear or tail section 98 to the center section 40. The magnetic attraction between the metal plates 80 and the metal plate (not shown) on the upper member 106 of the center section 40 serves a similar purpose.

Referring still to the partially exploded view of FIG. 4 a cover plate 108 comprising part of the lower member 42 and the mechanism 38 adapted for ejecting the front cockpit section 16 is disclosed. A vertically oriented cylindrical protrusion 110 having an aperture 112 in the center thereof is provided on the base plate 52. The aperture receives a matching shaft 114 which supports an upwardly extending fork 116. The two members 118 of the fork 116 are accomodated within two appropriately located apertures (not shown) in the cover plate 108. A cylindrical spring 120 is positioned on the shaft 114. The shaft 114 also supports a horizontal extension 122 which projects forward towards the front section 16 and terminates in a hook type member 124. The horizontal extension 122 is inserted into a hollow cylindrical member 126 having a slot 128 on top of the cylindrical body so that the hook 124 slightly protrudes therethrough. The cylindrical member 126 is in turn supported by a base 130 which is held by an appropriately dimensioned ledge 132 between the base plate 52 and the cover plate 108 of the lower member 42.

The cylindrical member 126 is dimensioned to fit within the aperture (not shown) provided within the rear of the front section 16. As the cylindrical member is inserted into the aperture (not shown) the spring 36 is compressed and the hook 124 engages a plate (not shown) provided within the front section 16. Thus the front section 16 is attached to the center section 40. When a child user of the present invention desires to eject the front section 16, he merely depresses the fork 116. This disengages the hook 124 causing the compressed spring 36 to propel the front section 16 forward as a launched vehicle.

A pair of elongated side members 134 are mounted between the base 52 and cover plates 108 by appropriately dimensioned ledges 136 which engage the respective vertically disposed walls 137 of the base 52 and cover plates 108. Each elongated side member 134 incorporates an aperture 138 in substantially the center thereof to accomodate a matching protrusion or stud adapted for attaching a pair of wing sections 140, shown in FIGS. 1 and 2. The cover plate 108 is attached to the base plate 52 by a plurality of screws 142 which are inserted into hollow vertically disposed cylindrical extensions 144 of the base plate 52.

The upper member 106 of the center section 40 includes a substantially rectangular flat plate 146 and an elevated, substantially rectangular hollow member 148 mounted thereonto. The flat plate 146 includes the magnetizable metal plate (not shown) which is held by magnetic forces to the protruding metal plates 80 of the contact elements 78. Both the flat plate 146 and the hollow member 148 include apertures 150 to accomodate the members 118 of the fork 116. The flat plate 146 and the hollow member 148 are attached to one another by a plurality of screws (not shown).

A leaf spring 152 biasing a rectangular ejector plate 154 is attached to the flat plate 146. The ejector plate 154 incorporates two short cylindrical protrusions or prongs 156 on each side thereof. The prongs are held in matching apertures 158 located within a pair of vertically disposed inner side walls 160 of the hollow member 148. The ejector plate is thus capable of limited rotational movement relative to the upper member 106.

As the ejector plate 154 is depressed by an outside force against the leaf spring 152 it engages a ledge 162 provided in a lever 164. When the ejector plate 154 is held by the ledge 162 against the leaf spring 152, it occupies a substantially horizontal position parallel with the flat plate 146.

The lever 164 is confined for limited pivotal movement in two small apertures (not shown) provided in the inner wall 160 and engages a hollow vertically disposed actuating member 166. The actuating member 166 is held in a matching aparture (not shown) which is provided in a top portion 168 of the hollow member 148. It is biased in an upwardly direction by a cylindrical coil spring 170. The coil spring 170 is in contact with the flat plate 146 on one end, and is inserted into the hollow actuating member 166 on another end. Thus the coil spring 170 permanently biases the actuating member 166 and therewith the lever 164 into a position wherein the ejector plate 154 is held to be disposed horizontally against the leaf spring 152.

A seat 172 dimensioned to fit between the parallelly disposed inner walls 160 of the hollow member 148 is supported by the ejector plate 154. The toy doll or robot 20, shown in FIG. 1, is placed in a sitting position upon the seat 172. When the child user of the toy airplane 12 of the present invention presses down the actuating member 166, the lever 164 pivots in a downwardly direction and the ejector plate 154 is no longer restrained by the ledge 162. As a result, the leaf spring 152 suddenly pushes the ejector plate 154 in an upwardly direction and the seat 172 together with the toy doll 20 therein is catapulted in a forwardly direction to fall into the hollow front section 16. Thus a child playing with the toy of the present invention, prior to launching the front section 16 as a separate vehicle, may transfer the robot thereinto.

Referring to the exploded perspective view of FIG. 2 the rear or tail section 98 of the toy airplane 12 of the present invention is disclosed. The tail section 98 comprises a hollow member which incorporates two batteries 174 and a control switch 176 adapted for selectively disconnecting or supplying power from the batteries 174 to the electric motor 44. As it was briefly pointed out above, the control switch 176 is capable of supplying power to drive the drive wheels 48 in either a clockwise or a counterclockwise direction at the option of the user of the present invention. The mounting of suitable batteries in toy airplanes and in like toy objects and the structure of control switches capable of performing the functions described above is well established in the prior art, and therefore need not be described here in detail.

The tail section 98 includes two magnetizable metal terminals 96 having a portion complementary in shape to the arcuate contact elements 78. Electric current is transmitted from the batteries 174 to the motor 44 through these terminals 96 and the contact elements 78.

As the terminals 96 and contact elements are fitted and held together by magnetic attraction, the additional magnetizable metal plate 104 on the tail section 98 also comes into contact with the slightly protruding portions of the magnetized metal plates 80. These provide additional force for the physical attachment of the tail section 98 to the center section 40.

The tail section 98 when it is attached to the center section 40, is further supported by a substantially flat plate 178 protruding rearwardly from the center section 40. A pair of wheels 180 are mounted below the flat plate 178.

A substantially vertically disposed simulated control or stabilizing surface 182 is mounted in substantially the center of a top surface of the tail section 98. The stabilizing surface 182 receives a pair of removably mounted toy missile launchers 184. The missile launchers are spring loaded and are capable of retaining and upon the press of a trigger 186 launching a toy missile 188. The mounting of the stabilizing surface 182 as well as the mounting of the missile launchers 184 thereto is accomplished by press fitting suitable cylindrical protrusions or studs into matching aparatus.

The toy airplane of the present invention further comprises the pair of wing sections 140, one wing section 140 being mounted on either side of the center section 40.

Each wing section 140 comprises a hollow substantially rectangular center section 190. The center section 190 is provided with a removable, press fitted transparent plastic canopy 192 so that the center section 190 itself simulates a cockpit of a smaller airplane. A hollow pointed nose cone 194 and a two-piece stabilizing surface 196 is press fitted respectively to the front and rear of the center section 190. A spring loaded operable toy dart hand gun 198 which is capable of retaining and launching a dart 200 is removably attached to a side of the center section 190. The attached dart gun 198 is disposed in a substantially horizontal position. Thus the assembled center section 190, the nose cone 194, the stabilizing surfaces 196 and the dart gun 200 effectively simulate an airplane wing.

In order to provide the toy airplane of the present invention with a remote control feature a second tail section 202, shown in FIG. 4, is provided.

The second tail section 202 comprises a substantially vertically disposed member 204 and a rearwardly pointed horizontally disposed simulated stabilizing surface 206 which is integrally constructed with the vertically disposed member 204. The second tail section 202 is capable of removably receiving on a top portion thereof the stabilizing surface 182 having the missile launchers 184 attached thereto. A pair of rearwardly pointed substantially conical hollow members 207 are attached to the second tail section 202 in order to further enhance its realistic warplane like apearance.

The second tail section 202 incorporates a pair of magnetizable metal terminals 208 and a magnetizable metal plate 210. These provide magnetic attachment to the metal plates 80 of the magnetizable contact elements 78 in the center section 40. The magnetic and electric coupling of this second tail section 202 to the center section 40 is essentially identical to the like coupling of the first tail section 98.

The magnetizable terminals 208 are connected by a suitable insulated cable 212 to a connecting member 214. The connecting member 214 includes in a suitable plastic housing 216, a permanent magnet 218 and a pair of arcuate magnatizable contact elements 220. The structure of the magnet 218 and the contact elements 220 is similar to the structure of the magnet 84 and of the contact elements 78 provided in the center section 40.

The magnetizable contact elements 220 interface with the terminals 96 provided in the first tail section 98, shown in FIG. 2, and establish magnetic and electrical contact therewith. Thus current is supplied from the batteries 174 through the cable 212 to the motor 44. Therefore the toy airplane 12 having the second tail section 202 mounted thereto, is remotely controllable by the control switch 176 which is located in the first tail section 98.

FIGS. 3, 5, 6 and 7 show additional play options provided by the unique airplane of the present invention.

Referring specifically to FIG. 3 a travelling toy gun assembly 222 seating the toy doll or robot 20 is illustrated.

The travelling toy gun assembly 222 is readily assembled by removing the dart gun 198 from the wing section and press fitting into a barrel 224 portion thereof a single 226 and a dual wheel assembly 228.

Figure 5:
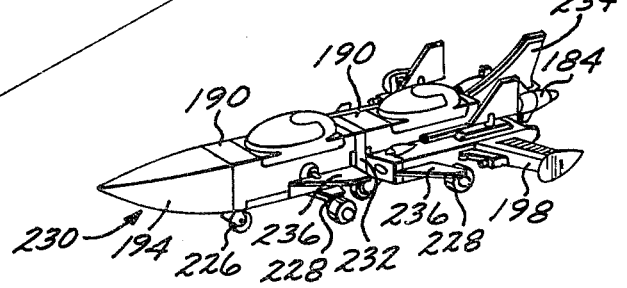
FIG. 5 is a perspective view of a smaller toy airplane which is obtained by reconfiguring a plurality of component parts of the wing sections of the toy airplane of the present invention.

Referring to FIG. 5 an airplane 230 having tandemly disposed dual cockpits is disclosed. The airplane 230 is assembled from one nose cone 194, the two center sections 190, the two dart guns 198 and from one two piece stabilizing surface 196. These parts originally comprise component parts of the wing sections 140. As illustrated in FIG. 5, the two center sections 190 are linearly connected to one another by utilizing a rectangular connecting piece 232 which is provided with cylindrical protrusions or studs (not shown) to engage suitably located apertures (not shown) in the center section 190. The nose cone 194 is attached to the front of the first center section 190, and one dart gun 198 is attached to either side of the second center section 190. The horizontally disposed dart guns 198 comprise the wings of this smaller airplane 230.

The two piece stabilizing surface 196 is dismantled and a major vertically disposable segment 234 thereof is attached to the rear of the second center section 190. There, it receives on two sides thereof the two missile launchers 184.

A single 226 and two dual wheel assemblies 228 provide support to the assembled smaller airplane 230. Additional simulated stabilizing or control surfaces 236 for attachment to the respective sides of the front center section 190 and to the dart guns 198 are provided.

Figure 6:
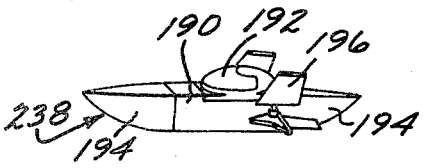
FIG. 6 is a perspective view of a small boat which is obtained by reconfiguring a plurality of component parts of the wing sections of the present invention.

Referring to FIG. 6 a speed-boat 238 assemblable from one center section 190, the two nose cones 194 and from the two-piece stabilizing surfaces 196 is disclosed. One nose cone 194 is attached respectively to the front and the rear of the center section 190, and one two-piece stabilizing surface 196 is attached to either side of the center section 190. The realistic appearance of the speed-boat 238 is enhanced by the fact that the top plastic canopy 192 of the center section 190 is removable and various toy objects including toy dolls may be placed in the resulting cavity.

Referring to FIG. 7, a toy airplane 240 having parallelly disposed dual cockpits is disclosed.

The airplane 240 is configured from the two center sections 190, the two nose cones 194, the two dart guns 198 and from the two major segments 234 of the two-piece stabilizing surfaces 196. In order to assemble the airplane 240 the two center sections 190 having the dart guns 198 and the nose cones 194 attached thereto in the same configurations as in the wing section 140, are mounted side by side through a connecting member (not shown). The connecting member (not shown) essentially comprises a relatively short tube which is capable of receiving a cylindrical protrusion or stud 242, shown in FIG. 2, located on a side of both center sections 190. The major segments 234 of the two-piece stabilizing surfaces 196 are attached to the rear of the center sections 190. In order to enhance the realistic warplane like appearance of the airplane 240 a missile launcher 184 is attached to a top side of each dart gun 198. The dart guns 198 here, as in the airplane 230 serve as wings. A plurality of wheel assemblies (not shown) are provided to support the airplane 240.

What has been described above is a self-propelling toy airplane, the component parts of which are reconfigurable to provide additional toy appendages. It will be readily apparent to those skilled in the toy manufacturing arts that various modifications of the present invention are possible and accordingly the scope thereof should be interpreted solely from the following claims.

What is claimed is:

1. A reconfigurable toy vehicle comprising:

a main body section including a rear body section and having at least one wheel for locomotion, the main body section incorporating an electric motor and at least one electric energy cell providing power for the motor, the motor being operatively connected to the wheel to drive the same, the main body section further incorporating control means for energizing the motor and for selectively causing the wheel to turn in one of a clockwise and counterclockwise direction;

a front body section removably mounted to the main body section, the front body section configured to simulate another vehicle, whereby the front body section when removed from the toy vehicle comprises a second separate toy;

a pair of side body members each having a hollow main section and a removable nose cone mounted thereto, the hollow main section configured to simulate a main body of a boat, the two nose cones being attachable to a front and a rear side of either hollow main section when the same is removed from the toy vehicle, the assembled hollow main section and the two nose cones comprising a separate toy boat, and a pair of toy handguns, each handgun being removably attachable to a side of each hollow main section of the side body members to simulate wings for the toy vehicle.

2. The invention of claim 1 wherein the rear body section is removably attached to the main body section by magnetic means, the energy cell is located in the rear body section and the magnetic means also provide for transmission of electric power from the rear body section to the electric motor contained in the main body section.

3. The invention of claim 1 wherein the removable mounting of the front body section to the main body section is accomplished by spring loaded means, the spring loaded means adapted for selectively ejecting the front body section whereby the separate toy is launched.

4. The invention of claim 1 further comprising a humanoid doll, and wherein the main body section includes a seat for the humanoid doll and spring loaded means for selectively ejecting the humanoid doll together with the seat to fall into the front body section whereby the humanoid doll simulating a commander of the toy vehicle is transferred into the separate toy.

5. The invention of claim 4 further comprising a plurality of wheels removably attachable to each handgun when the handgun is removed from the toy vehicle, and wherein each handgun is configured to simulate a main body section of a travelling toy gun assembly and is provided with means for seating the humanoid doll whereby the handgun removed from the toy vehicle and assembled with the plurality of wheels becomes a separate travelling toy gun assembly.

6. The invention of claim 5 wherein each handgun is an operable toy dart gun.

7. A toy airplane assembly capable of reconfiguration into subcombination toys, the airplane assembly comprising:

a main fuselage section;

a front section removably mounted to the main fuselage section and configured to simulate an airplane nose section and a secondary vehicle, a first rear section removably mounted to the main fuselage section, and a pair of wings, one wing being removably mounted on either side of the main fuselage section, each wing comprising a center section, a nose cone removably mounted to the front of the center section, at least one simulated stabilizing surface mounted to the rear of the center section, and a side section mounted to the center section, the side section when removed from the toy airplane assembly being a toy handgun capable of ejecting toy projectiles.

8. The invention of claim 7 wherein the main fuselage section has drive means capable of propelling the toy airplane assembly on a substantially solid surface and wherein the main fuselage section incorporates an electric motor capable of driving the drive means.

9. The invention of claim 8 wherein the first rear section incorporates an electric power source to energize the electric motor and switch means for selectively supplying power to the electric motor.

10. The invention of claim 9 further comprising at least one toy missile launcher capable of retaining and launching toy missiles, the missile launcher being removably mounted to the first rear section.

11. The invention of claim 9 further comprising a second rear section capable of being mounted to the main fuselage section when the first rear section is removed therefrom, the second rear section having means for transmission of power from the power source located within the first rear section to the electric motor whereby the locomotion of the toy plane assembly is remotely controlled.

12. The invention of claim 11 wherein the means for transmission of power include a cable and a plurality of magnetically coupled contact elements.

13. The invention of claim 12 wherein the drive means comprise a pair of wheels mounted to provide rotational movement relative to a substantially horizontally disposed axle of rotation, the pair of wheels being operably attached to the electric motor through a crown gear having a vertically disposed axle of rotation, whereby both the rotational movement of the wheels on a horizontal axis and a rotational movement of the axle of the wheels on a vertical axis may be energized by the electric motor resulting in the airplane assembly's capability to change direction of motion when an obstacle is encountered in the path of its motion.

14. The invention of claim 7 wherein the center sections of the wings are configured to simulate a cockpit of an airplane and wherein the two center sections, the two side sections, the plurality of simulated stabilizing surfaces and one nose cone section when removed from the airplane assembly are reconfigurable to provide a second airplane in which the two center sections are assembled one after the other in a straight line disposition and thereby comprise a fuselage having tandemly disposed dual cockpits, and in which second airplane the side sections comprise wings.

15. The invention of claim 14 further comprising at least two toy missile launchers capable of retaining and launching toy missiles, the two missile launchers being removably mounted to the first rear section of the toy airplane assembly, the two missile launchers also capable of being removably mounted to a tail section of the second airplane.

16. The invention of claim 7 wherein the center sections of the wings are configured to simulate a cockpit of an airplane and wherein the two center sections, the two side sections, the two nose cones and the simulated stabilizing surfaces when removed from the airplane assembly are reconfigurable to provide another airplane in which the two center sections each having one nose cone mounted thereto are assembled in a parallel disposition to one another and provide a fuselage of the other airplane having parallelly disposed dual cockpits and in which other airplane the side sections comprise wings.

17. The invention of claim 16 further comprising at least two toy missile launchers capable of retaining and launching toy missiles, the two toy missile launchers being removably mounted to the first rear section of the toy airplane assembly, the two missile launchers also capable of being removably mounted to the wings of the other airplane.

18. In a toy airplane including a fuselage and having an electric motor to drive at least one wheel an improvement comprising:

a center section of the fuselage housing the electric motor and the wheel driven thereby;

a front cockpit section removably attached to the center section, the front cockpit section having a plurality of wheels and configured to form a secondary vehicle when separated from the toy airplane;

a first tail section removably attached to the center section, the first tail section including a power source to energize the electric motor and a control switch to turn on the electric motor;

a second tail section removably attachable to the center section of the fuselage when the first tail section is removed therefrom, the second tail section having a cable and a plurality of contact means for drawing power from the power source located in the first tail section and for transmitting power to the electric motor housed in the center section whereby the toy airplane may be remotely controlled by the switch located in the first tail section.

19. In the toy airplane of claim 18 a further improvement comprising spring loaded means for selectively retaining and launching the front cockpit section of the fuselage thereby simulating the launching of the secondary vehicle.

20. In the toy airplane of claim 18 a further improvement comprising a seat located in the fuselage, a humanoid doll adapted for seating in the seat and spring loaded means for selectively ejecting the humanoid doll from the seat.

21. In the toy airplane of claim 18 a further improvement comprising a pair of wings, each wing comprising a center section, a pointed front section removably mounted to the center section and a side section removably mounted to the center section, the side section configured to simulate a toy handgun.

22. In the toy airplane of claim 21 a further improvement wherein the side section is an operable dart launching handgun.

23. In the toy airplane of claim 21 a further improvement wherein the center sections of the wings are configured to simulate the cockpit of an airplane and wherein the two center sections, the two side sections and at least one of the two pointed front sections are reconfigurable to provide at the option of the user of the invention one of an airplane having parallelly positioned dual cockpits and an airplane having tandemly positioned dual cockpits where in both of the reconfigured airplanes the side sections comprise wings.

24. In the toy airplane of claim 21 a further improvement comprising a plurality of wheel assemblies mountable to each side section of the wing when the side section is removed from the toy airplane, whereby the side section having the plurality of wheels mounted thereto comprises a separate travelling toy gun assembly.

25. A reconfigurable toy vehicle comprising:

a main body section including a rear body section and having at least one wheel for locomotion;

a front body section removably mounted to the main body section, the front body section configured to simulate another vehicle and having at least one wheel for locomotion and a cavity adapted to accommodate a toy doll, spring means incorporated in the main body section for ejecting at the option of a player the front body section whereby a second separate toy vehicle is launched;

a pair of side body members each having a hollow main section and a removable nose cone mounted thereto, the hollow main section configured to simulate a main body of a boat, the two nose cones being attachable to a front and rear side of either hollow main section when the same is removed from the toy vehicle, the assembled hollow main section and the two nose cones comprising a separate toy boat, and a pair of toy handguns, each handgun being removably attachable to a side of each hollow main section of the side body members to simulate wings for the toy vehicle.

26. The invention of claim 25 wherein the rear body section is removably attached to the main body section, the main body section incorporates an electric motor operatively connected to the wheel of the main body section, the rear body section incorporates at least one electric battery operatively connected to the motor when the main and rear body sections are assembled, and the rear body section incorporates switch means for energizing the electric motor at the option of a player whereby the toy vehicle is capable of propelling itself on a support surface.

27. The invention of claim 25 wherein the main body section includes a removably mounted seat, a toy doll capable of being seated upon the seat, and spring means for ejecting the seat together with the doll into the cavity of the front body section.

* * * * *